United States Patent [19]

Ito et al.

[11] 4,451,220

[45] May 29, 1984

[54] ROTARY COMPRESSOR WITH CLEARANCE BETWEEN MOVABLE VANES AND SLITS OF THE ROTOR

[75] Inventors: Seitoku Ito, Okazaki; Kenji Takeda, Aichi; Mitsuo Inagaki, Okazaki; Nobuo Motoda, Kariya, all of Japan

[73] Assignee: Nippon Soken, Inc., Nishio, Japan

[21] Appl. No.: 311,402

[22] Filed: Oct. 14, 1981

[30] Foreign Application Priority Data

Oct. 16, 1980 [JP] Japan ..... 55-148118[U]
Oct. 16, 1980 [JP] Japan ..... 55-148119[U]

[51] Int. Cl.[3] ..... F03C 2/00
[52] U.S. Cl. ..... 418/255
[58] Field of Search ..... 418/253–258; 29/156.4 R

[56] References Cited

U.S. PATENT DOCUMENTS

| | | | |
|---|---|---|---|
| 992,929 | 5/1911 | Winans | 418/255 |
| 1,505,788 | 8/1924 | Larson | 418/258 |
| 4,144,005 | 3/1979 | Brucken | 418/255 |

*Primary Examiner*—Leonard E. Smith
*Assistant Examiner*—Jane E. Obee
*Attorney, Agent, or Firm*—Cushman, Darby & Cushman

[57] ABSTRACT

A rotary compressor includes a cylindrical-shaped housing, a rotor rotatably mounted in the housing and formed with diametrically extending slits, and a pair of movable vanes each slidably disposed in each of the slits with its opposite ends extending beyond the associated slit in abutting relation to the inner surface of the housing. The clearances between the movable vanes and the slits of the rotor are made larger about the central portion of the rotor than adjacent to the outer periphery thereof by making each of the vanes thinner about its central portion than at its opposite end portions or making each of the slits wider about the central portion of the rotor than adjacent to the outer periphery of the rotor. With the arrangement, shearing stresses caused by shearing of oil in the compressor can be suppressed to thereby reduce a loss in the torque of the compressor, and the maximum stress on the movable vanes can be limited below an allowable stress to improve the anti-breakage characteristics of the vanes.

1 Claim, 15 Drawing Figures

ROTARY COMPRESSOR WITH CLEARANCE BETWEEN MOVABLE VANES AND SLITS OF THE ROTOR

BACKGROUND OF THE INVENTION

This invention relates generally to a rotary compressor having vanes and which is useful as a refrigerant compressor in air-conditioning systems for vehicles.

In rotary compressors used for compressing refrigerant, refrigerant is usually mixed with oil in order that sliding portions of the compressor can be well lubricated and sealed. Such oil is generally of high viscosity, so that as vanes slidably move in slits of a rotor upon the rotation thereof, oil of high viscosity is sheared by the vanes to develop high shearing stresses, thereby causing a loss of torque. Additionally, in this type of rotary compressors, refrigerant which contains therein a large quantity of liquid refrigerant is compressed at the start-up of operation to develop liquid compression, thereby extremely increasing the pressure in a working chamber of the compressor to cause breakage of movable vanes. There have heretofore been proposed many measures to cope with these phenomenons. However, these prior measures could not effectively solve the problems.

SUMMARY OF THE INVENTION

It is an object of the invention to provide a rotary compressor in which slits formed in a rotor are stepped to be larger in width near the center of the rotor such that shearing stresses produced when oil in the compressor is sheared can be reduced, thereby providing a marked effect in reducing loss in torque, in particular, when oil is of high viscosity at the start-up in low temperatures.

In one aspect of the invention, the stepped configuration of the slits in the rotor enables enlarging the distances between the supporting points where the vanes bear against the slits in high load operation of the compressor, so that resistant forces acting at the supporting points can be suppressed to reduce frictional loss thereat.

In another aspect of the invention, each of movable vanes is reduced in thickness at its central, narrow portion in a manner to attain positional adjustment of the supporting points between the movable vanes and the slits of the rotor when overloads are applied on the rotor, thereby suppressing the maximum stress on the movable vanes below an allowable stress to greatly improve the anti-breakage characteristics of the vanes.

DESCRIPTION OF THE PREFERRED EMBODIMENT

Figure 1:
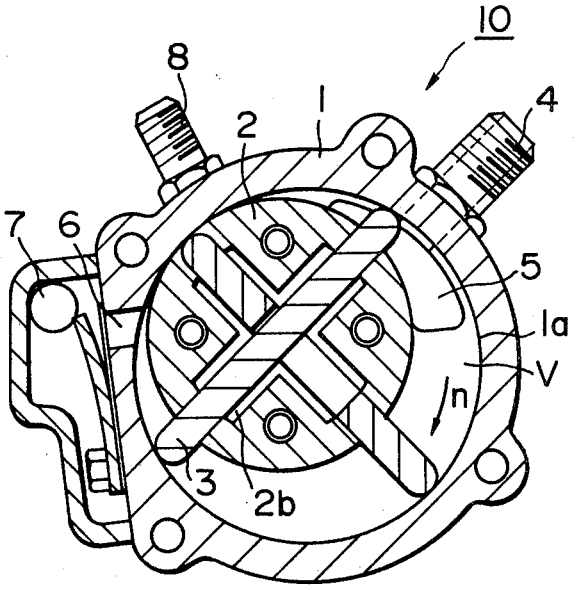
FIG. 1 is a sectional view of a rotary compressor according to a first embodiment of the invention.
Figure 2:
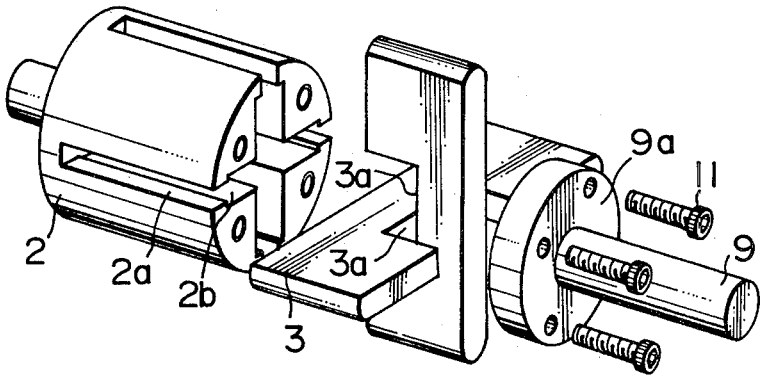
FIG. 2 is a perspective view of a rotor and vanes in the rotary compressor of FIG. 1.

Referring now to FIGS. 1 and 2 of the drawings, there is shown a rotary compressor 10 according to an embodiment of the invention, which comprises a housing 1, a rotor 2 made of iron materials and formed with slits 2*a*, 2*b* and a pair of vanes 3 made of aluminum alloy and slidably mounted in said slits 2*a*, 2*b* of the rotor. As shown in FIG. 2, each of said vanes 3 is relieved at its central portion to provide a recess 3*a* for prevention of interference between said vanes 3 during operation. The two vanes 3 are received in the slits 3*a* of the rotor with the recesses 3*a* thereof crossed. The rotor 2 secures thereto a flange 9*a* of a shaft 9 by means of bolts 11 while receiving said vanes 3 in the slits 3*a* thereof, and is rotatively mounted in eccentric relation in the housing 1 with the outer periphery thereof slidably engaged by a portion of the inner peripheral surface 1*a* of said housing 1. The tip ends of the respective vanes 3 are adapted to slidably engage the inner peripheral surface 1*a* of the housing 1, so that the sliding movement of the vanes 3 is limited by the profile of the inner peripheral surface 1*a* of the housing 1. A compression chamber or working chamber V is thus defined by the outer periphery of the rotor 2, the inner peripheral surface 1*a* of the housing 1 and the vanes 3, and expands and contracts as the rotor 2 rotates in the direction of arrow n. Refrigerant from an evaporator (not shown) is absorbed via an inlet pipe 4 and an inlet port 5 into the compression chamber V upon expansion thereof, and is compressed upon contraction of the compression chamber to be discharged via an outlet port 6, a discharge passage 7 and an outlet pipe 8 to a condenser (not shown).

Figure 4:
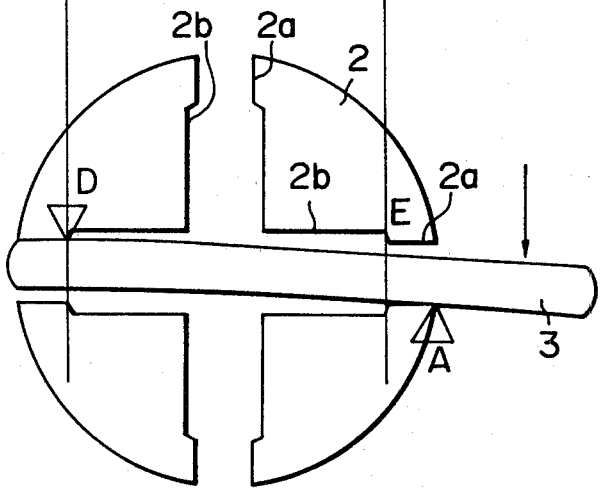
FIG. 4 is a diagrammatic view showing the positional relationship of a vane in slits provided with stepped portions.

Referring now to FIG. 4, the rotor 2 is formed with stepped portions 2*b* which are contiguous to said slits 2*a* and extend therefrom toward the axis of the rotor 2, and of which width is larger than that of the respective slits 2*a*. The width of the respective slits 2*a* is substantially the same as the thickness of the vanes 3 to eliminate ingress of the refrigerant from the compression chamber V into the slits 2*a*, and the clearance between the slits 2*a* and the vanes 3 is extremely small (for example, on the order of 20 to 30 $\mu$m) while the clearance between the stepped portions 2*b* and the vanes 3 is relatively large (for example, on the order of 0.5 to 1.0 mm). The provision of such stepped portions 2*b* in accordance with the present invention makes it possible to reduce frictional resistance caused by the sliding movement of the vanes 3, as described hereinafter in more detail.

As the rotor 2 rotates in the housing 1, the vanes 3 move slidingly in the slits 2*a* and the stepped portions 2*b* to thereby shear a lubricating oil adhered to the surfaces of the slits 2*a*. The shearing stress $\tau$ thus produced is represented by an equation $$\tau=\mu(v/\chi)$$

where $\mu$ is a coefficient of viscosity, v the velocity of the vanes 3, and $\chi$ the clearance between the vanes 3 and the slits 2*a*. The shearing stress in turn produces a torque which is represented by an equation $$T=\tau Sv/2\pi Ne$$

where S is a sliding area where the vanes 3 slidingly engage the slits 2*a* and Ne is the speed (rps) of the compressor. In order to reduce the loss of torque, it is desired to enlarge the clearance between the slits 2*a* or to reduce the sliding area since the velocity of the vanes 3 and the coefficient of viscosity are respectively constant. However, enlargement of the clearance between the vanes 3 and the slits 2*a* is not acceptable because the sealing characteristics therebetween is impaired.

In accordance with the present invention, the slits 2*a* are partly enlarged to provide the stepped portions 2*b*, thereby reducing the sliding area S to attain reduction in the loss of torque without changing the material of the rotor 2 and increasing the weight thereof. The stepped portions 2*b* do not require such working of high precision as the slits 2*a* do, so that grinding of the slits 2*a* is facilitated.

Figure 3:
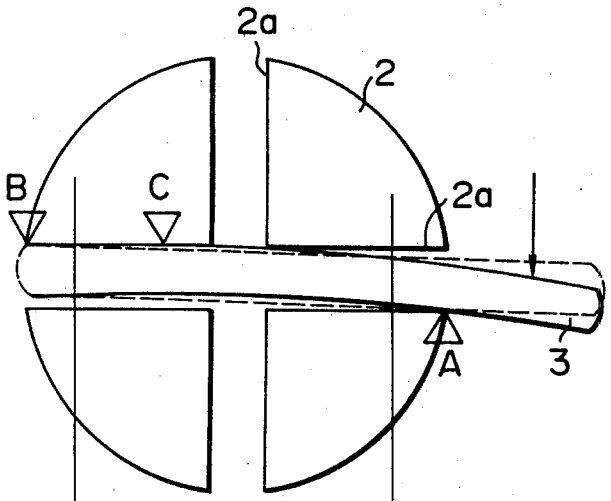
FIG. 3 is a diagrammatic view showing the positional relationship of a vane in prior slits without stepped portions.

In one aspect of the present invention, the loss of torque caused by flexure of the vanes 3 can be reduced. More specifically, the vanes 3 are not so much flexed when the rotary compressor operates at low loads. With the flat slits 2*a* of the prior art as shown in FIG. 3, the vane 3 is supported at supporting points A and B near the outer periphery of the rotor 2. As the load on the rotary compressor increases, the supporting point B shifts toward the right, as at C, as viewed in FIG. 3. Thus the distance between the supporting points is changed as represented by the inequality $\overline{BA}>\overline{CA}$ with the result that the forces of resistance acting at the respective supporting points become large. In contrast, with the slits 2*a* provided with the stepped portions 2*b* in the present invention, as shown in FIG. 4 the shifting of supporting point B toward the right, under increasing compressor load, cannot go beyond the beginning of the stepped portion 2*b*, i.e., beyond point D, because of the clearance between the vane 3 and the stepped portion 2*b*. Thus, the distance between the supporting points is equal to or more than the distance $\overline{DA}$ even during the high load operation of the rotary compressor. Accordingly, any increase in the forces of resistance due to the shifting of the supporting points can be suppressed to reduce the loss of torque.

Figure 5:
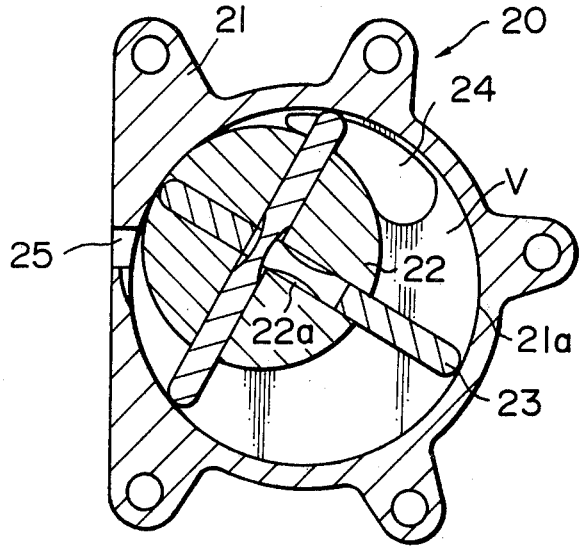
FIG. 5 is a sectional view of a rotary compressor according to a second embodiment of the invention.
Figure 6:
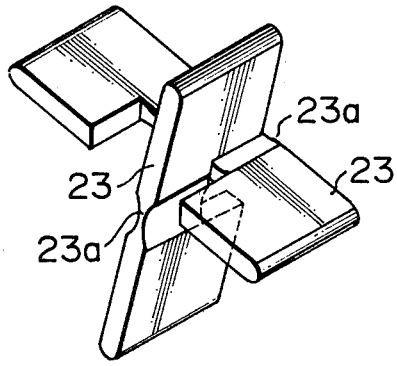
FIGS. 6 and 7 are perspective views of a vane or vanes in the rotary compressor of FIG. 5.
Figure 7:
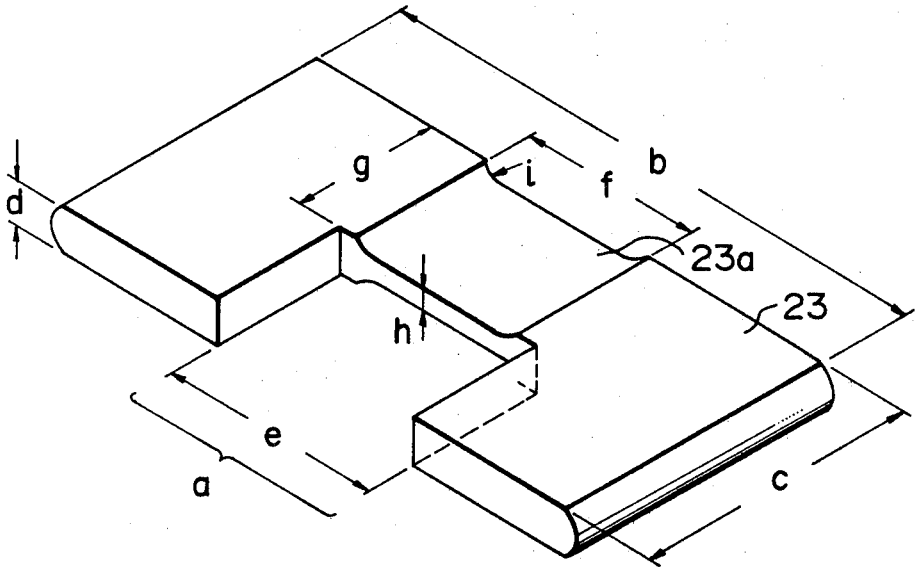

Referring now to FIG. 5, there is shown a fluid compression section of a rotary compressor 20 constructed in accordance with another embodiment of the present invention, which section comprises a housing 21 made of an iron material, a rotor 22 made of an iron material and disposed in eccentric relation to the axis of said housing 21, and movable vanes 23 made of an aluminum alloy and slidably received in slits 22*a* of said rotor 22. As shown in FIGS. 6 and 7, each of said vanes 23 of the rotary compressor is centrally relieved at 23*a* and is C-shaped. The central narrow portions 23*a* are crossed to each other to prevent mutual interference between said vanes 23 in operation, and are thinned as compared with the remaining portions of the vanes 23 to advantageously perform elastic deformation. There is provided a fine clearance of the order of 20 to 30 $\mu$m between each of the vanes and each of the slits 22*a* of the rotor 22 so that the refrigerant is prevented from flowing through the clearance in great quantities. The movable vanes 23 are rounded at their opposite ends to slidably engage the inner peripheral surface of the housing 21 at all times, and the outer peripheral surface of the rotor 22 slidably engages a portion of the inner peripheral surface of the housing 21. A compression chamber working chamber V is defined by the inner peripheral surface of the housing 21, the outer periphery of the rotor 22 and the adjacent vanes 23, and is adapted to cyclically expand and contract as the rotor 22 begins to rotate upon receipt of a driving power from outside, for example, from an engine of a vehicle. Depending upon the expansion and contraction of the working chamber V, the refrigerant is introduced thereinto from an evaporator (not shown) through an inlet port 24, and is discharged through an outlet port 25 to a condenser (not shown).

Figures 9A, 9B:
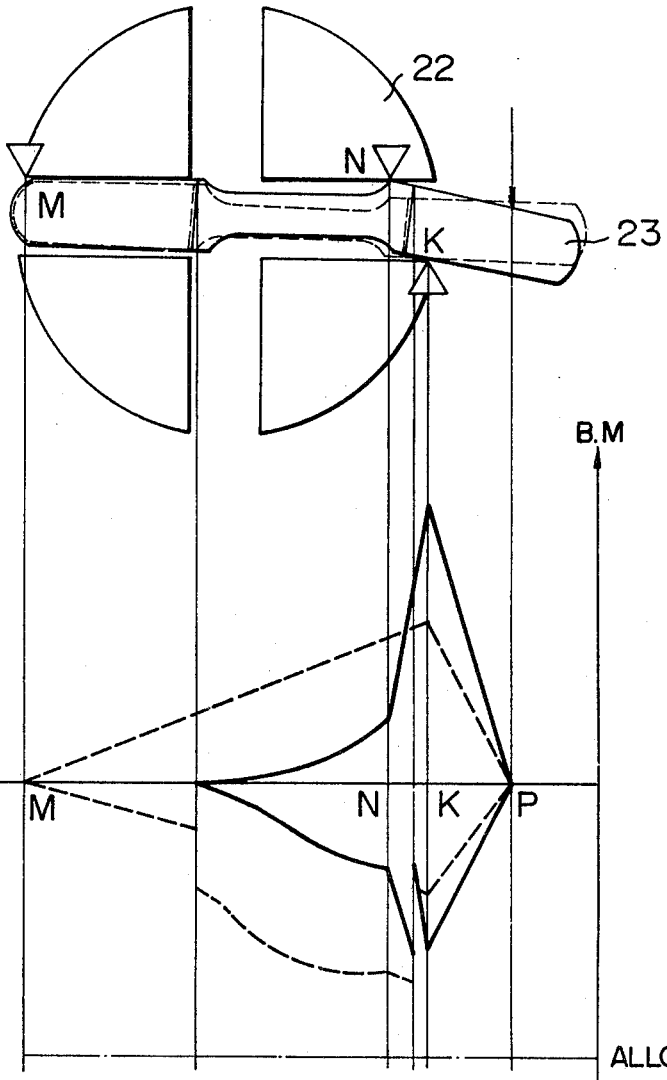
FIG. 9*a* is a view showing the vane abutting against the slit in the rotary compressor of FIG. 5.
FIG. 9*b* is a diagram showing bending stress and moment produced in the vane as shown in FIG. 9*a;*

In operation, the working chamber V contracts at the start-up of the rotary compressor while containing therein a great amount of a non-compressible fluid (for example, liquid refrigerant). In this condition, the so-called liquid compression occurs to raise the pressure in the working chamber V to the extraordinary extent. The central narrow portions 23*a* of the vanes 23 in the present invention are thinned to avoid breaking the vanes 23 even at the time of the liquid compression. More specifically, the central narrow portions 23*a* of the vanes 23 are reduced in flexural rigidity and increased in flexibility due to reduction in the thickness thereof, so that when a large load is applied on the vanes 23 as at the occurrence of the liquid compression, the central narrow portions 23*a* flex to cause the vanes 23 to abut against the inner surfaces of the associated slit 22*a* at the boundary K of the outer periphery of the rotor 22 and the slit 22*a* and at the edge N of the central narrow portion 23*a*, as shown in FIG. 9. With no regard to the effects due to torsion and stress concentration, the bending stress distribution in the vane 23 is shown by solid line in FIG. 9*b* in which the bending stress is maximum at point K. As the moment of inertia of area of the vane 23 at joint K is about twice as that at the central narrow portion 23*a*, the value of the bending stress at point K is relatively small and does not exceed that of the permissible stress, so that the vanes 23 are hard to break. In FIG. 9*a*, the position of the movable vane 23 in normal operating condition of the rotary compressor is shown by dotted line, and the bending stress distribution and the bending moment distribution in the vane in normal operating condition of the rotary compressor are shown by dotted lines in FIG. 9*b*. As seen from FIG. 9*a*, the vane 23 abuts against the associated slit 22*a* at the edges K, M thereof in normal operating condition of the compressor.

Figure 9C:
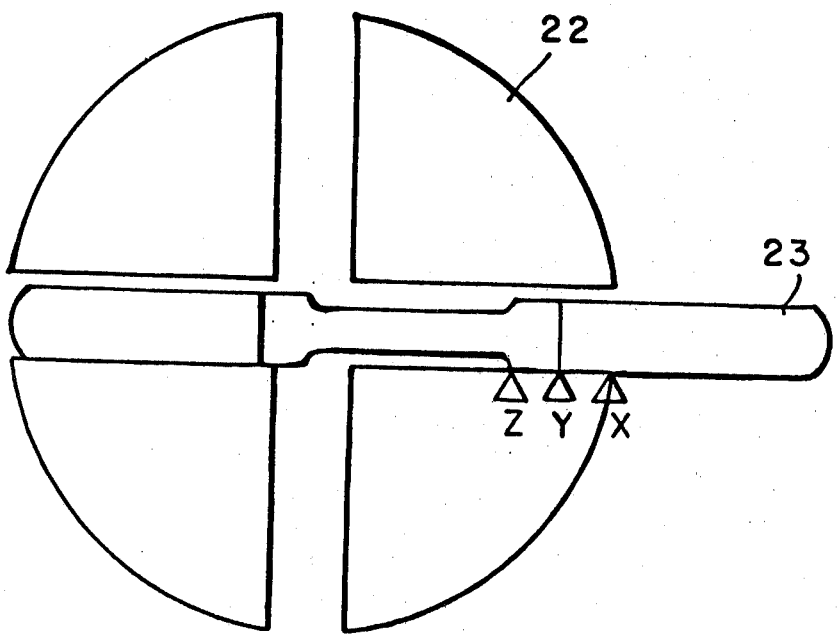
FIG. 9*c* is a view corresponding somewhat to FIG. 9*a* showing the vane in unstressed condition.

Referring to FIG. 9*c*, the points X and Z correspond to the points K and N, respectively, in FIG. 9*a*, while the point Y on the side surface of the vane 23 corresponds to an end of the narrow width portion of the vane. The distances $\overline{XY}$ and $\overline{YZ}$ preferably are substantially equal because, as shown in FIG. 9*b*, when they are equal the bending stress of the point X (K in FIG. 9*b*) is substantially equal to that of point Y.

Figures 10A, 10B:
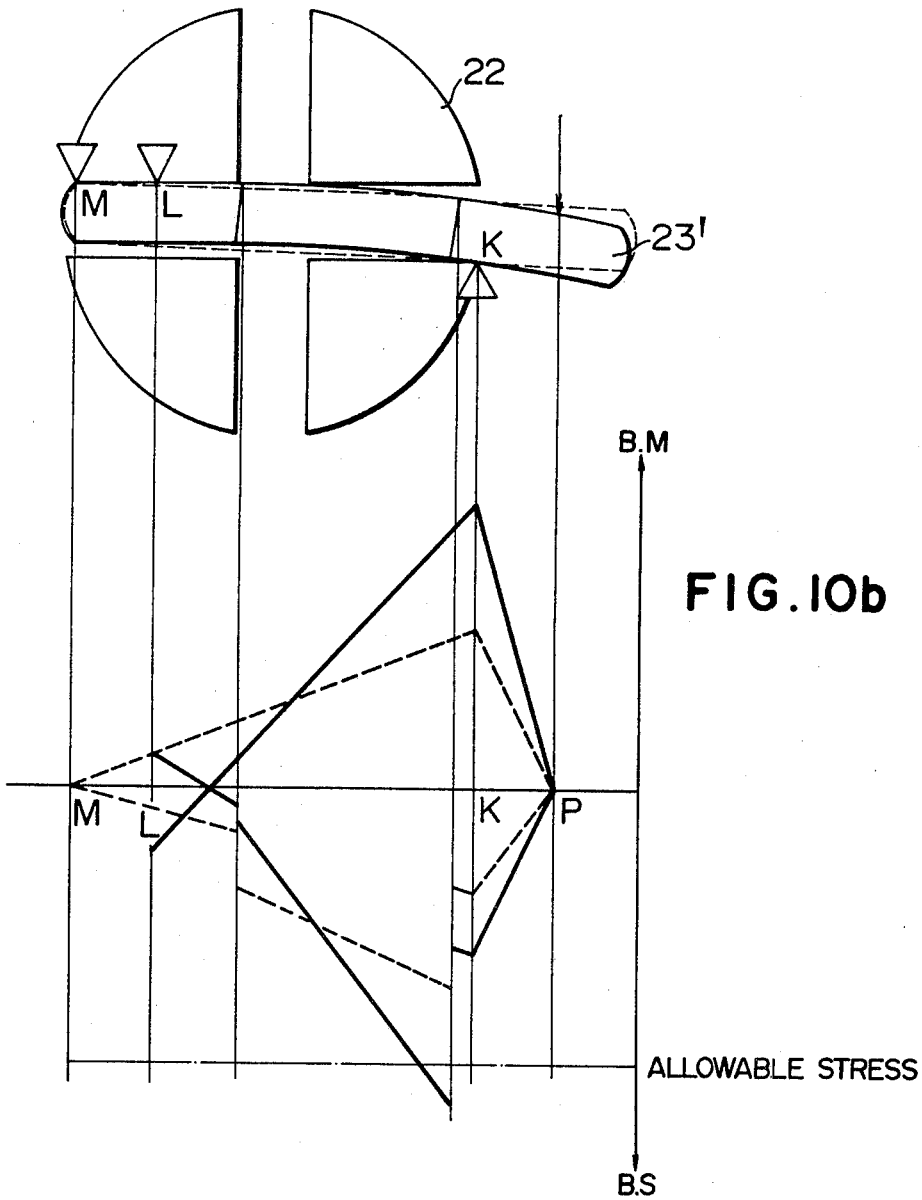
FIG. 10*a* is a view showing a prior vane abutting against the slit in the rotary compressor.
FIG. 10*b* is a diagram showing bending stress and moment produced in the prior vane of FIG. 10*a;*

In order to assist understanding of the present invention with respect to the vanes 23, the bending stress produced in that vane 23' which is flat and is not thinned at the central narrow portion 23'a thereof will be explained with reference to FIGS. 10a and 10b. In FIG. 10a, the position of the vane 23' is shown by solid line when a large load is applied on the vane 23' in the condition of liquid compression, and is shown by dotted lines when normal compression is effected in the rotary compressor. In FIG. 10b, solid lines represent the distributions of bending stress and bending moment produced in the vane 23' in the solid line position of FIG. 10a, and dotted lines represent the distributions of bending stress and bending moment produced in the vane 23' in the dotted line position of FIG. 10a. As seen from FIG. 10a, the flat vane 23' when subjected to a large load abuts against the slit 22a at the relatively spaced points K, L. Accordingly, the vane 23' as shown in FIG. 10a is subjected to a large bending load at the end of the central narrow portion 23'a thereof, and thus a greatly large bending stress is produced in the central narrow portion 23'a since the moment of inertia thereof is half of that of the remaining portion of the vane. Consequently, it is possible that the maximum value of the bending stress exceeds that of the allowable stress to cause the vane 23' to break at the end of the central narrow portion 23'a.

Figure 8:
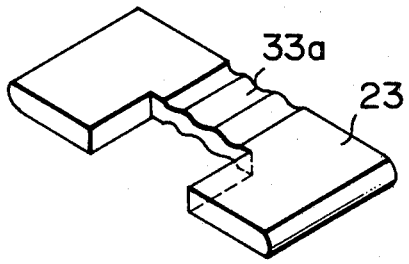
FIG. 8 is a perspective view of a vane according to another embodiment of the invention.

The effects of the present invention will be numerically illustrated by indicating the experimental results with respect to the rotary compressor of the present invention and the prior rotary compressor provided with the vanes 23' as shown in FIG. 10a. The vanes used were made of an aluminum alloy containing Si of 20% and having a tensile strength of 25 kg/mm$^2$. Using the characters in FIG. 7, the vane 23 provided with the thinned walled narrow portion 23a had the following dimensions, that is, b=68 mm, c=29 mm, d=6 mm, e=24.5 mm, f=17 mm, g=14.3 mm, h=3.5 mm, and i=9 mm. The rotor 22 had an outer diameter of 50 mm and was made of SCM 21 with its surface portion quenched and ground. The clearance between the inner surfaces of the slit 22a and the surfaces of the vanes 23 was 30 $\mu$m. A compression tester was made exclusively for these experiments to produce a load corresponding to the bending load at the time of liquid compression. In the experiment, the point of load were set to be positioned at midpoint between the outermost end of the vane 23 and the outer diameter portion of the rotor 22. Under these set conditions, measurement was made with respect to the load at the time of the vane being broken and to the location where breaking occurred. The vane 23' employed for comparison with the vane 23 was made of the same material as that of the vane 23, and had the same dimensions as those of the vane 23 except that the vane 23' was not thinned at the center portion thereof. As the result of the experiment, the vane 23 having the thin walled narrow portion was broken under the load of 440 kg at the portion thereof which abutted against the outer diameter portion of the rotor 22. On the other hand, the flat vane 23' was broken under the load of 240 kg at the end of the central narrow portion 23'a. Here, the allowable load in the construction used was assumed to be 300 kg. Thus it has been ascertained from the result of the experiment that the vane can be prevented from being broken at its central narrow portion to improve the anti-breakage characteristics at the time of liquid compression, only by making the central narrow portion thin-walled without changing the material of the vane or increasing the weight thereof. Of course, the thickess of the thinned walled narrow portion of the vane can be changed depending upon the total length b of the vane, the thickness d and the width c of the vane, and the clearance between the inner surfaces of the respective slit 22a of the rotor 22 and the respective vanes 23. In the embodiment described above, the movable vane 23 is centrally scraped off to provide the central narrow portion 23a. As the anti-breakage characteristics of the vanes can be similarly improved when the flexural rigidity is reduced in a manner to cause the vane to contact the rotor in the same manner as in the above embodiment, the central narrow portion of the vane 23 can be corrugated as at 33a in FIG. 8.

Figure 11:
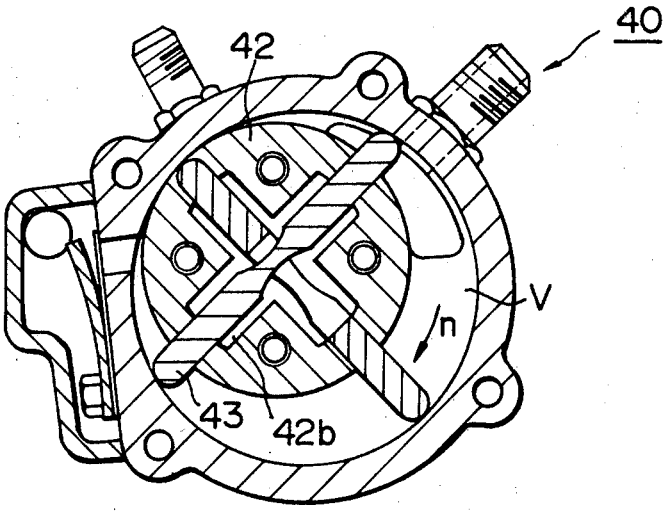
FIG. 11 is a sectional view of a rotary compressor according to a third embodiment of the invention.
Figure 12:
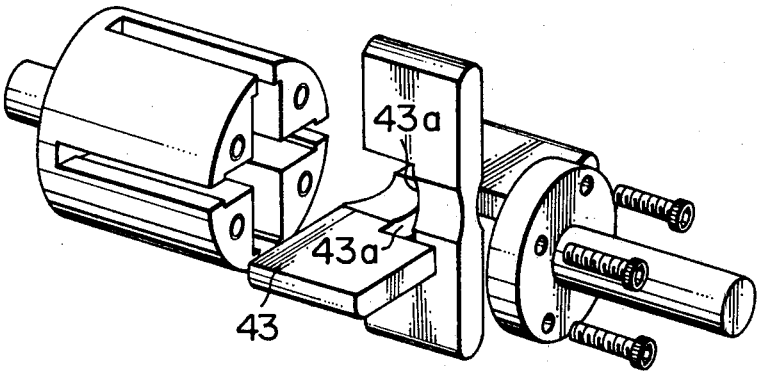
FIG. 12 is a perspective view of a rotor and vanes in the rotary compressor as shown in FIG. 11.

Referring now to FIGS. 11 and 12 of the drawings, there is shown a rotary compressor 40 according to a third embodiment of the invention, which is similar to the rotary compressor 10 of the first embodiment in FIG. 1 except that each of vanes 43 is centrally scraped off to provide a thin walled narrow portion 43a. Slits 42b formed in the rotor 42 are stepped as shown in FIG. 11, so that shearing stresses can be reduced which are caused when oil existing in the compressor is sheared by the vanes, thus providing a superior effect in reducing the loss of torque. Moreover, the provision of the thin walled narrow portion on the vane results in that even when an overload is applied on the rotor, the maximum stresses on the movable vanes can be limited below an allowable stress by adjusting the position of the supporting points between the movable vanes and the inner surfaces of the slits of the rotor. Accordingly, the anti-breakage characteristics of the movable vanes can be greatly improved.

The invention disclosed will have many modifications which will be apparent to those skilled in the art in view of the teachings of the specification. It is intended that all modifications which fall within the true spirit and scope of this invention be included within the scope of the appended claims.

What is claimed is:

1. A rotary compressor comprising a cylindrical-shaped housing, a rotor rotatably mounted in said housing and formed with two diametrically extending slits, and two movable substantially flat vanes each slidably disposed in a corresponding slit with the opposite ends thereof extending beyond said slit in abutting relation to the inner surface of said housing, said vanes having interlocking central portions of narrower width than that of the remaining portions of said vanes, the thickness of each of said vanes in a portion of said central portion of less length than the latter being less than that of said remaining portions, and a first distance from a point X on a side surface of each vane which is contacted by the outer edge of the corresponding slit when the vane is projected to its maximum extent to a point Y on the side surface of said vane corresponding to an end of said narrower width portion of said vane and a second distance from said point Y to a point Z on the adjacent edge of said reduced thickness portion are substantially equal.

* * * * *